US005085577A

United States Patent [19]

Muller

[11] Patent Number: 5,085,577

[45] Date of Patent: Feb. 4, 1992

[54] BURNER WITH TOROIDAL-CYCLONE FLOW FOR BOILER WITH LIQUID AND GAS FUEL

[75] Inventor: Rudolf Muller, Aigle, Switzerland

[73] Assignee: MEKU Metallverarbeitunge GmbH, Daughingen, Fed. Rep. of Germany

[21] Appl. No.: 630,992

[22] Filed: Dec. 20, 1990

[51] Int. Cl.[5] ..... F23Q 3/00

[52] U.S. Cl. ..... 431/265; 431/115; 431/183

[58] Field of Search ..... 431/265, 115, 183

[56] References Cited

U.S. PATENT DOCUMENTS 3,385,527 5/1968 Drewry ..... 431/265

4,561,841 12/1985 Korenyi ..... 431/265

FOREIGN PATENT DOCUMENTS 1243907 8/1971 United Kingdom .

*Primary Examiner*—Carroll B. Dority

*Attorney, Agent, or Firm*—Mason, Fenwick & Lawrence

[57] ABSTRACT

A burner is of generally tubular configuration, and comprises an inner shell and an outer shell. The inner shell has therein a nozzle, an ignition electrode, and a sight tube. An annular gap is provided between the two shells, through which a comburant-gas flows to an annular, inwardly directed and constricted discharge opening, with swirl blades upstream of the discharge opening. A comburant-gas supply passes through openings in the inner shell upstream of a baffle which is positioned transversely of the inner shell, and which has radial slots therein inclined to the plane of the baffle to cause swirling of comburant-gas passing through the slots in the baffle. A toroidal-cyclone combustion zone is created due to the slots in the baffle creating a swirling downstream flow downstream of the baffle, and the inwardly directed annular and constricted opening, which aspirates comburant-gas which has passed through the baffle.

11 Claims, 1 Drawing Sheet

BURNER WITH TOROIDAL-CYCLONE FLOW FOR BOILER WITH LIQUID AND GAS FUEL

BACKGROUND OF THE INVENTION

Figure 1:
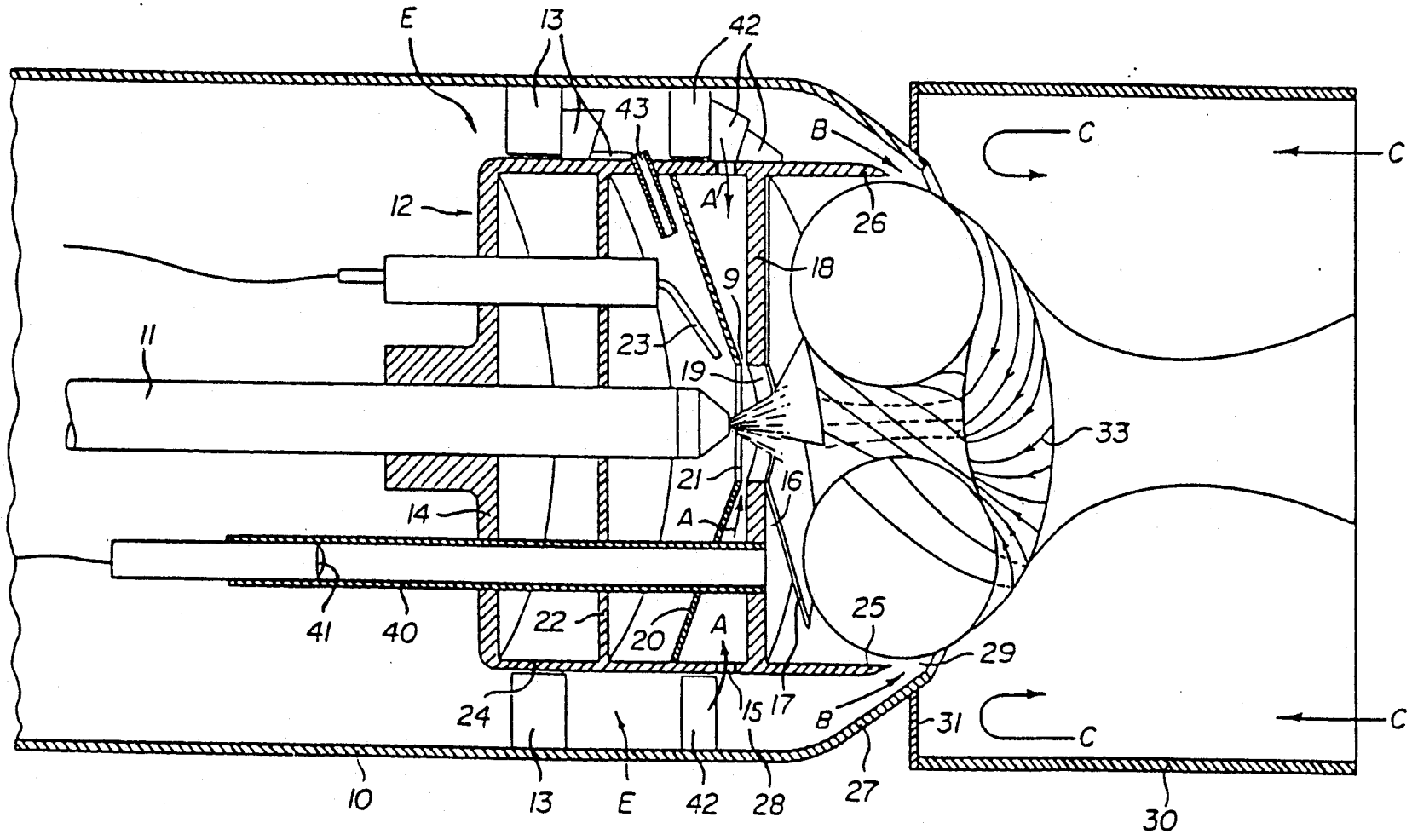

The present invention relates to a burner with toroidal-cyclone flow for a liquid and gas fueled boiler having a tubular body, composed of an outer shell and an inner shell mounted coaxially with the outer shell, a fuel supply nozzle located coaxially inside these shells, and ignition electrodes, wherein the inner shell and the outer shell define an annular gap between them provided with a constricted circular opening in front of the burner.

Various types of burners are already known in which the comburant and fuel gases are mixed downstream of the nozzle such as to generate two-phase combustion intended to improve the quality of combustion obtained in this burner. Burners of this type often allow combustion to be significantly improved, but without achieving the expected results, in particular low enough nitrogen oxide and carbon dioxide levels for the combustion gases to be below the tolerances set by current and future codes.

It should be pointed out that clean, complete combustion of a liquid or gaseous fuel mixed with a comburant gas, namely air, can be achieved only if the following three conditions are fulfilled:

a) The fuel must be divided into extremely fine particles;

b) The fuel-comburant mixture must be in very definite proportions;

c) Guidance of the fluids must be ensured to allow complete mixing of the substances involved and generate a fluid-dynamics flow of combustion gas.

In a burner of the "Low NOx" type, it is essential to achieve combustion in two phases. The first phase consists of starting combustion with a rich mixture and the second phase consists of carrying out this combustion under conditions approaching stoichiometric conditions. With regard to the problem of particulate division of the fuel, it is known that optimum combustion is only possible if the fuel is in the form of extremely fine particles. It is also known that a stratified mixture of fuel and comburant must be obtained, and for this it is essential to maximize use of the effects resulting from the flow of these fluids and turbulence with a small pressure loss inside the burner. In general, too much air cools the flame and handicaps combustion. Too little air, on the other hand, leaves unburnt gases and favors formation of carbon monoxides. If fuel-comburant mixing is done poorly, i.e. if the resulting mixture is not stratified, it is not possible to achieve a mixing coefficient minimizing the quantities of harmful substances and/or pollutants in the combustion gases. In this case, the flame obeys its own laws of dynamic behavior. When the mixture is stratified, however, and is composed of air and finely divided fuel particles burned in the first combustion phase, the flame burns at a fully predetermined rate. To obtain a stable flame, the mixture must be created with precision and fed at a constant rate corresponding to the speed of the flame front. For combustion to be complete and the efficiency of the flame to be at a maximum with no undesirable residues appearing in the combustion gases, it is necessary for the adjustments defining turbulences and residence times of the gases in the burner to be fully defined. Recycling of combustion gases has beneficial advantages since it allows the mixture to be preheated, the residence time of the gases in the burner to be increased, and favorable influences to be exerted on the chemical reactions that occur. This recycling must however be done very carefully and the quantity of recycled gases must be optimally specified as a function of the quantities of primary, secondary, and tertiary air injected.

Burners known to date do not in general allow the various parameters to be optimally reconciled so that the results of combustion gas analyses generally give values over the threshold permitted by current and future regulations, or flame oscillations often occur with fouling of the device, or they are of exorbitant cost.

The present invention proposes to mitigate these disadvantages by providing a burner of relatively simple and economical construction which causes a toroidal-cyclone flow to be created with direct recycling of the combustion gases, which has the effect of achieving an extremely fine division of the fuel particles, a stratified mixture of the fuel and comburant gas, in this case air, efficient recycling of the combustion gases, and hence a sufficiently long residence time of the gases in the burner for unburnt residues to be virtually nonexistent.

SUMMARY OF THE INVENTION

This goal is achieved by the burner according to the invention comprising an inner shell blocked behind a nozzle by a hermetic sealing plate, and a baffle provided with a central orifice and with radial slots through it in planes inclined with respect to the plane of the baffle. The side wall of this inner shell is provided with at least one opening arranged to generate a primary comburant gas supply flow which passes through the slots in the baffle, and there is at least one ring of inclined blades disposed in an annular gap between the inner shell and an outer shell, downstream of which is an annular constricted opening; these blades swirl a secondary comburant gas supply flow.

According to one preferred embodiment, the burner has a primary gas supply flow guide surface between the sealing plate of the inner shell and the baffle, with a central orifice disposed opposite the central orifice of the baffle.

Advantageously, said guide surface provides, with the baffle, a constricted annular passage surrounding the central orifice of this baffle, for the primary comburant gas supply flow.

This guide surface is preferably conical.

In this embodiment, the outer shell has a cylindrical upstream part and a downstream part, disposed in front of the nozzle, having a conical surface whose generatrices converge in front of the nozzle, on the axis of the latter.

This burner may also have a combustion gas recycling sleeve, mounted in front of the nozzle, attached at the downstream end of the outer shell.

This sleeve is attached to the outer shell by means of an annular part disposed in a plane perpendicular to the axis of this burner.

Advantageously, the inner shell is equipped with a comburant gas supply tube connecting the annular gap between the shells and the interior of the inner shell in order to tap off part of the comburant gas supply flow to the ignition electrodes.

Said inner shell may be attached to the outer shell by at least three legs disposed in diametrical planes and preferably by a ring of legs also disposed regularly in diametrical planes.

The present invention will be better understood by reference to the description of embodiments and the attached drawing wherein:

The single FIGURE is an axial section with parts in elevation, of a preferred embodiment of a domestic or industrial burner according to the invention.

With reference to the FIGURE, the burner shown has essentially a tubular body composed of an essentially cylindrical outer shell 10 and an inner shell 12 disposed coaxially to outer shell 10. A nozzle 11, disposed coaxially to inner shell 12 and outer shell 10 is mounted inside inner shell 12. These two shells are disposed such as to enclose between them an annular gap E whose function will be specified below. Inner shell 12 is shut off at its upstream end by a hermetic sealing plate 14 and at its downstream or front end by a baffle 18 having a central opening 19 and a series of radial slots 16 disposed in planes inclined with respect to the plane of the baffle. In practice, these slots can be cut obliquely in the baffle, or the baffle itself can be composed of vanes 17 which overlap partly to define said inclined slots.

The lateral part of inner shell 12 has at least one opening 15, but preferably a series of openings spaced regularly and disposed in a circular line to ensure passage of a primary comburant gas supply flow upstream of baffle 18.

This supply flow, illustrated by arrows A, comes from a blower or fan (not shown) disposed behind the burner and sending air into annular gap E in the downstream direction. Since the upstream end of inner shell 12 is closed by sealing plate 14, this space is the only possible passage into the inner shell 12 for a substantial amount of the air flow generated by the blower.

Primary flow A is guided in the direction of central orifice 19 of baffle 18 and toward radial slots 16 by a guide surface 20 which is preferably conical and has at its central region an orifice 21 disposed opposite orifice 19. The base of this surface is attached to side wall 24 of inner shell 12. The edges of orifice 21 define, with the edges of orifice 19, an annular passage 9 with a constricted cross section forming a throttle through which the primary supply flow is accelerated and which feeds the jet of fuel ejected by nozzle 11, and protects the latter against heat and fouling by forming a protective screen.

As shown in the figure, side wall 24 of this inner shell 12 extends beyond baffle 18 by an annular rim 25 which, at its end zone 26, is incurved toward the burner axis. Moreover, outer shell 10 extends toward the front of the burner in a downstream part 27 composed of a conical surface which, with rim 25, forms an annular passage 28 extending downstream of annular gap E and terminating downstream of the nozzle in a constricted circular opening 29. This annular passage 28 is traversed by a secondary comburant gas supply flow represented by arrows B. This secondary comburant gas supply flow B also comes from the blower and passes through annular gap E. This secondary flow B corresponds partially to the remainder of the total flow generated by the blower after separation of primary flow A.

Inner shell 12 also has an intermediate plate 22 parallel to sealing plate 14 which serves to hold or attach ignition electrodes 23 (only one of which is shown in the figure) and a sight tube 40 equipped with a photoelectric cell 41.

Inner shell 12 is attached to outer shell 10 by at least three legs 13 and preferably by a ring of regularly spaced legs. These legs are disposed in diametrical planes. Said ring is preferably mounted near the upstream end of side wall 24 of the inner shell.

A ring of inclined blades 42 is mounted in annular gap E downstream of the ring of legs 13. The purpose of these blades is to swirl secondary comburant gas supply flow B and generate the cyclone effect in front of the nozzle. In other words, these blades are designed to confer a rotational component around the injector axis on gas flow B. This swirling or cyclone effect is supplemented by passage of the primary flow through slots 16. The effect has the following consequences:

- improved homogeneity of the mixture;
- increased residence time of combustible mixture in combustion zone;
- improved recycling of combustion gases.

A tube 43 is mounted on inner shell 12 to connect annular gap E and the inside of shell 12 in order to tap off part of the comburant gas supply flow in the direction of ignition electrodes 23. The stream of air generated through this tube causes the ignition arc struck between the electrodes to be deflected toward nozzle 11.

In front of the burner body is a sleeve 30 connected by an annular part 31 to outer shell 10. The combustion gases are recycled in a path shown by arrows C, in a direction opposite to that of the flame, i.e. upstream. This phenomenon contributes to stabilizing the flame.

The toroidal-cyclone effect shown schematically by the curves and arrows 33 is obtained by the combination of several effects. A first effect is obtained by injection of fuel droplets in the opposite rotational direction to the toroidal-cyclone vortex. A second effect is brought about by the primary comburant-gas feed which is brought at low speed through openings 15 and then through the slots 16 between the inclined vanes 17 of baffle 18. These vanes 17, inclined at a predetermined angle, cause penetration of the air corresponding to the primary supply as a set of swirling air streams encircling the fuel fluid flow and moving downstream. Part of the primary flow a forms a screen protecting nozzle 11 against heat and fouling. The secondary comburant-gas flow B, swirling due to blades 42, passes through the outlet 29 and penetrates the space located in front of baffle 18. Because of the throttle provided by outlet 29, the swirling air penetrating this zone is greatly accelerated. This creates a region of lower pressure inwardly of conical part 27 rim 25, aspirating air which has passed through the slots 16 in baffle 18. In addition, the deflection brought about by rims 25 and 27 generates an enveloping current which creates a very stable cyclone zone, a rotating torus, in the vicinity of the baffle 18. The rotational component or swirling generated by blades 42 favors the particular dynamics of the gas flow in this zone. This toroidal-cyclone zone improves the division of fuel particles and very efficiently homogenizes the fuel-comburant mixture. In addition, it considerably prolongs the residence time of the gases in the combustion zone, which is a factor for achieving complete combustion. Finally, recycling of the combustion gases through sleeve 30 allows the gas mixture in the combustion zone to be kept at a relatively high preheating temperature and complete combustion of any initially unburnt gases swept along with the combustion gases to be ensured.

The results of tests conducted show particularly clearly that the combination of the various effects obtained by the design features of this burner leads to highly favorable practial results. More specifically, combustion, because of the heat it gives off, causes vaporization of the fine fuel particles which, because of the turbulence, are mixed with a predetermined quantity of air. Let CxHy be the fuel formula, where x and y have different values in a specific range. The air is made essentially of a mixture of 21% oxygen and about 78% nitrogen, 1% argon, and traces of carbon dioxide and other gases. The reactions that occurs during combustion, particularly because of heating of the mixture to the ignition temperature, are the following:

Formation of a negative oxygen ion by heat shocks in the air according to the relation:

$$N{=}N+O{=}O \rightarrow N^{+}{=}N^{-}+O{-}O^{-}$$

Formation of a fuel radical and a hydrogen radical by pyrolysis according to the relation:

$$CxHy \rightarrow H+CxH(x-1)$$

The oxygen ion reacts immediately with the fuel, and the hydrogen radical with the oxygen, or with the fuel according to the following relations:

$$CxHy+.O{-}O \rightarrow CxH(y-1)+H{-}O{-}O$$

$$O{=}O+.H \rightarrow .O{-}O{-}H$$

$$CxHy+.H \rightarrow .CxH(y-1)+H{-}H$$

The peroxide radical H—O—O also reacts as a dehydrogenator with the fuel according to the relation:

$$H{-}O{-}O.+CxHy \rightarrow H{-}O{-}H+.O{-}H+.CxH(y-1)$$

while the H—O—O ion generates an oxidation reaction according to the relation:

$$CxHy+O{-}O{-}H \rightarrow CxH(y-1){-}O+.O{-}H$$

The combustion occurring after ignition has two fundamental features:

1) The ions and radicals forming upon ignition are constantly renewed as needed and the fuel is converted as it is used up;

2) Because of the exothermal reactions which give off a great deal of heat, the igniter is self-sustaining.

Because of mositure in the comburant air, the H and O—H— radicals are considerably increased, which allows the quality of combustion to be increased. Ideal combustion of a CxHy fuel in the presence of the stoichiometric air quantity theoretically necessary to ensure complete combustion corresponding to the following chemical equation:

$$CxHy+(x+y/4)O_2+4.(x+y/4)N_2 \rightarrow xCO_2=y/2\text{-}H_2O+(4x+y)N_2$$

it being understood that the combustion air has one part of oxygen to 4 parts of nitrogen. The combustion ratio is given in this case by the following formula:

$$\text{lambda} = \frac{\text{molecular weight of air}}{\text{molecular weight of fuel} \times 5 \cdot (x + y/4)}$$

This theoretical combustion is generally impossible in practice since the reaction of decomposition into radicals does not occur so cleanly.

In paralle to the reactions according to the theoretical equation below:

$$H{-}O{-}O.+CHO \rightarrow H{-}O{-}H+O{=}C{=}O$$

decomposition also occur according to the following relations:

$$N{=}N.+O{-}O{-}H \rightarrow 2N{=}O+.H$$

$$.C{-}H2+.O{-}H \rightarrow .CH+H{-}O{-}H$$

$$.CH+O{-}O{-}H \rightarrow C{=}O+H{-}O{-}H$$

during which hydrocarbon combustion is incomplete and carbon monoxide and soot form according to the relation:

$$.CH+.O{-}H \rightarrow .C+H{-}O{-}H$$

The advantages of the above burner are obtained essentially because of the toroidal-cyclone effect which is generated by the design features defined above. The axial position of the inner shell may be modified according to the power of the burner.

The present invention is not confined to the embodiments described, but may undergo various modifications and be presented with variants obvious to the individual skilled in the art. In particular, the number of inclined blades, or rings of blades, is not limited. The number of slots 16 may be increased or decreased and the dimension of the various openings for passage of the comburant gas supply flows may be modified.

What is claimed:

1. A fuel burner apparatus for establishing toroidal-cyclone flow of liquid fuel and comburant gas comprising:

a generally cylindrical outer shell;

a generally cylindrical inner shell mounted coaxially in the outer shell and providing an annular space therebetween for passage of comburant gas;

said inner and outer shells having open forward downstream ends comprising means for providing a constricted annular gas discharge opening for directing gas toward the axis of said shells;

means in the space between said inner and outer shells for causing gas to swirl in said space in its passage to said constricted annular opening;

a nozzle for supplying fuel extending coaxially within the inner and outer shells upstream of said air discharge opening;

plates means extending across the end of said inner shell remote from said air discharge opening for preventing entry of gas into said inner shell through said remote end;

means adjacent said fuel nozzle for initiating combustion;

a baffle in said inner shell upstream of the comburant gas discharge opening and downstream of said fuel nozzle extending generally transversely of the axis of said shells and having a central orifice, and radial slots therethrough inclined to the plane of said baffle for causing comburant gas passing through said slots in said baffle to swirl; and means for enabling flow of comburant gas from the space betwen said inner and outer shells into a space in said inner shell upstream of said baffle for passage into and through said slots in said baffle;

whereby swirling gas passes through said constricted annular opening and aspirates swirling comburant-gas which has passed through said slots in said baffle.

2. The fuel burner according to claim 1, and further comprising a guide comburant-gas flowing into said inner shell located between said plate means and said baffle and provided with a central orifice disposed in alignment with said central orifice in said baffle.

3. The fuel burner according to claim 2, said guide being inclined towards said baffle at its inner region thereby defining with said baffle a constricted annular passage surrounding said central orifice of said baffle.

4. The fuel burner according to claim 3, said guide being conical.

5. The fuel burner according to claim 1, wherein said means for providing a constricted annular comburant gas discharge opening comprises a conical portion of said outer shell, the generatices of which converge in front of said nozzle and substantially on the axis of said nozzle.

6. The fuel burner according to claim 5, and further comprising means mounted downstream of said nozzle and attached to the downstream end of said outer shell for recycling combustion gases.

7. The fuel burner according to claim 6, wherein said recycling means comprising a sleeve having a transverse flange at one end thereof attached to the downstream end of said outer shell.

8. The fuel burner according to claim 1, and further comprising a comburant-gas supply tube extending from said annular space into said inner shell and comprising means for directing comburant-gas towards said menas for intiating combustion.

9. The fuel burner according to claim 1, and a plurality of diametrically extending legs in said annular space comprising means for attaching said inner shell to said outer shell.

10. The fuel burner according to claim 1, wherein said nozzle comprises means for supplying furl by injecting the fuel droplets in the opposite rotational direction to that of the rotational direction in which said comburant gas is caused to swirl by said means for causing comburant gas to swirl.

11. A fuel burner apparatus for establishing toroidal-cyclone flow of liquid fuel and comburant-gas comprising:

means for discharging comburant-gas in an annular converging conical path and in a first direction of rotation;

means for discharging fuel substantially along the axis of said comburant-gas discharging means upstream thereof and in a rotational direction opposite to the rotational direction of said discharged comburant-gas;

a baffle extending transversely of said axis between said fuel discharging means and said comburant-gas discharging means and having a central orifice therein for passage of fuel;

means for defining an annular passage outwardly of said baffle for comburant-gas flowing towards said air discharging means;

means for diverting comburant-gas from said passage upstream of said baffle; and means for causing diverted comburant-gas to pass through said baffle with a swirling downstream movement.

* * * * *